US011178741B1

(12) United States Patent
Jacobs et al.

(10) Patent No.: US 11,178,741 B1
(45) Date of Patent: Nov. 16, 2021

(54) LIGHTING SYSTEM CONFIGURED TO EMIT VISIBLE AND INFRARED LIGHT

(71) Applicant: Hughey & Phillips, LLC, Urbana, OH (US)

(72) Inventors: Jeffrey A Jacobs, Galloway, OH (US); Steven M. Schneider, Urbana, OH (US); Brian J. Hockensmith, Columbus, OH (US)

(73) Assignee: Hughey & Phillips, LLC, Urbana, OH (US)

( * ) Notice: Subject to any disclaimer, the term of this patent is extended or adjusted under 35 U.S.C. 154(b) by 550 days.

(21) Appl. No.: 15/386,587

(22) Filed: Dec. 21, 2016

Related U.S. Application Data

(60) Provisional application No. 62/270,836, filed on Dec. 22, 2015.

(51) Int. Cl.

| | |
|---|---|
| ***H05B 45/37*** | (2020.01) |
| ***H05B 45/50*** | (2020.01) |
| *F21V 3/02* | (2006.01) |
| *F21Y 115/10* | (2016.01) |
| *F21Y 113/00* | (2016.01) |
| *F21V 7/00* | (2006.01) |
| *G08G 5/04* | (2006.01) |

(52) U.S. Cl.
CPC ..... *H05B 45/50* (2020.01); *H05B 45/37* (2020.01); *F21V 3/02* (2013.01); *F21V 7/00* (2013.01); *F21Y 2113/00* (2013.01); *F21Y 2115/10* (2016.08); *G08G 5/04* (2013.01)

(58) Field of Classification Search
CPC combination set(s) only.
See application file for complete search history.

(56) References Cited

U.S. PATENT DOCUMENTS

| | | | |
|---|---|---|---|
| 3,610,912 | A | 10/1971 | Schwartz |
| 4,498,004 | A | 2/1985 | Adolfsson et al. |
| 4,609,306 | A | 9/1986 | Loire |
| 5,155,666 | A | 10/1992 | Radford et al. |

(Continued)

FOREIGN PATENT DOCUMENTS

| | | | |
|---|---|---|---|
| CN | 201636748 | U | 11/2010 |
| EP | 1231109 | A1 | 8/2002 |

(Continued)

OTHER PUBLICATIONS

"LP-8862-Q1 Low-EMI Automotive LED Driver With Two 160-mA Channels," product data sheet, Aug. 2016, 10 pages, published by Texas Instruments, Dallas, Texas.

(Continued)

*Primary Examiner* — Amy Cohen Johnson
*Assistant Examiner* — Jianzi Chen
(74) *Attorney, Agent, or Firm* — Kegler Brown Hill + Ritter LPA Co.; Lorraine Hernandez

(57) ABSTRACT

A lighting system includes a first light emitter configured to emit light outside a visible-light spectrum. A second light emitter is configured to emit light in a visible-light spectrum. The first and second light emitters are co-located, such as in a stacked arrangement with one light emitted atop the other. The amount of visible illumination of the second light emitter may correspond to a correlated radiant intensity of infrared light emitted by the first light emitter.

20 Claims, 3 Drawing Sheets

(56) References Cited

U.S. PATENT DOCUMENTS

| | | | | |
|---|---|---|---|---|
| 5,608,290 | A | 3/1997 | Hutchisson et al. | |
| 5,642,933 | A | 7/1997 | Hitora | |
| 5,838,247 | A | 11/1998 | Bladowski | |
| 5,929,788 | A | 7/1999 | Vukosic | |
| 6,022,124 | A | 2/2000 | Bourn et al. | |
| 6,070,994 | A | 6/2000 | Sebek et al. | |
| 6,183,100 | B1 | 2/2001 | Suckow et al. | |
| 6,364,506 | B1 | 4/2002 | Gallo | |
| 6,379,026 | B1 | 4/2002 | Petrick | |
| 6,425,678 | B1 | 7/2002 | Verdes et al. | |
| 6,464,373 | B1 | 10/2002 | Petrick | |
| 6,525,668 | B1 | 2/2003 | Petrick | |
| 6,561,689 | B1 | 5/2003 | Kidd et al. | |
| 6,601,970 | B2 | 8/2003 | Ueda et al. | |
| 6,637,921 | B2 | 10/2003 | Coushaine | |
| 6,679,618 | B1 | 1/2004 | Suckow et al. | |
| 6,705,745 | B1 | 3/2004 | Pederson | |
| 6,793,372 | B2 | 9/2004 | Wehner et al. | |
| 6,932,496 | B2 | 8/2005 | Rizkin et al. | |
| 6,948,830 | B1 | 9/2005 | Petrick | |
| 6,962,423 | B2 | 11/2005 | Hamilton et al. | |
| 6,991,351 | B1 | 1/2006 | Petrick | |
| 7,040,782 | B2 | 5/2006 | Mayer | |
| 7,079,041 | B2 | 7/2006 | Fredericks et al. | |
| 7,160,004 | B2 | 1/2007 | Peck | |
| 7,163,322 | B2 | 1/2007 | Tatewaki et al. | |
| 7,236,105 | B2 | 6/2007 | Brenner et al. | |
| 7,237,929 | B2 | 7/2007 | Stahl | |
| 7,378,983 | B2 * | 5/2008 | Wang | H05B 45/22 340/815.45 |
| 7,497,593 | B2 | 3/2009 | Wang | |
| 7,568,821 | B2 | 8/2009 | Peck et al. | |
| 7,578,600 | B2 | 8/2009 | Czajkowski | |
| 7,604,384 | B2 | 10/2009 | Peck | |
| 7,658,513 | B2 | 2/2010 | Peck | |
| 7,758,210 | B2 | 7/2010 | Peck | |
| 7,791,497 | B2 | 9/2010 | Clerk | |
| 7,832,908 | B2 | 11/2010 | Peck et al. | |
| 8,033,683 | B2 | 10/2011 | Fields | |
| 8,096,677 | B2 | 1/2012 | Fields et al. | |
| 8,525,425 | B1 | 9/2013 | Roudeski | |
| 9,010,969 | B2 | 4/2015 | Roudeski et al. | |
| 9,013,331 | B2 | 4/2015 | Wise | |
| 9,016,896 | B1 | 4/2015 | Roudeski | |
| 9,206,961 | B1 | 12/2015 | Bastiani et al. | |
| 9,297,514 | B2 | 3/2016 | Roudeski | |
| 9,423,086 | B2 | 8/2016 | Peck | |
| 9,572,223 | B1 | 2/2017 | Mula et al. | |
| 9,694,914 | B2 | 7/2017 | Wise | |
| 9,702,525 | B1 | 7/2017 | Roudeski | |
| 10,106,276 | B2 | 10/2018 | Ricca et al. | |
| 10,124,910 | B2 | 11/2018 | Wise | |
| 2001/0015899 | A1 | 8/2001 | Kondo et al. | |
| 2004/0004836 | A1 | 1/2004 | Dubuc | |
| 2004/0057234 | A1 | 3/2004 | Mohacsi | |
| 2004/0057244 | A1 | 3/2004 | Amano | |
| 2004/0145910 | A1 | 7/2004 | Lisowski | |
| 2004/0196646 | A1 | 10/2004 | Machi et al. | |
| 2005/0094393 | A1 | 5/2005 | Czajkowski | |
| 2005/0157490 | A1 | 7/2005 | Klose | |
| 2006/0007012 | A1 | 1/2006 | Machi et al. | |
| 2006/0012990 | A1 | 1/2006 | Walser et al. | |
| 2006/0083017 | A1 | 4/2006 | Wang | |
| 2006/0291209 | A1 | 12/2006 | Booth et al. | |
| 2008/0192480 | A1 | 8/2008 | Rizkin et al. | |
| 2009/0207605 | A1 | 8/2009 | Fields | |
| 2009/0219715 | A1 | 9/2009 | Peck et al. | |
| 2010/0027281 | A1 | 2/2010 | Waters et al. | |
| 2010/0049454 | A1 * | 2/2010 | Irissou | H05B 45/58 702/58 |
| 2010/0084979 | A1 | 4/2010 | Burton et al. | |
| 2010/0194603 | A1 | 8/2010 | Wobben | |
| 2010/0244748 | A1 | 9/2010 | Haab et al. | |
| 2010/0259929 | A1 | 10/2010 | Henri et al. | |
| 2011/0018439 | A1 | 1/2011 | Fabbri et al. | |
| 2011/0051421 | A1 | 3/2011 | Chew | |
| 2011/0058370 | A1 | 3/2011 | Datz et al. | |
| 2011/0090681 | A1 | 4/2011 | Hobson | |
| 2011/0121734 | A1 | 5/2011 | Pape | |
| 2011/0194283 | A1 | 8/2011 | Roer | |
| 2011/0235322 | A1 | 9/2011 | Fields et al. | |
| 2011/0241926 | A1 | 10/2011 | Laufer | |
| 2011/0301567 | A1 * | 12/2011 | Boulanger | A61M 5/14232 604/500 |
| 2011/0305014 | A1 | 12/2011 | Peck | |
| 2012/0300449 | A1 | 11/2012 | Fields | |
| 2014/0036168 | A1 * | 2/2014 | Ludwig | H01L 27/323 349/12 |
| 2014/0062302 | A1 | 3/2014 | Tischler et al. | |
| 2015/0036222 | A1 * | 2/2015 | Mihara | G02B 27/14 359/630 |
| 2016/0201888 | A1 * | 7/2016 | Ackley | G03B 21/14 362/276 |
| 2016/0304215 | A1 | 10/2016 | Ricca et al. | |
| 2019/0055034 | A1 | 2/2019 | Ricca et al. | |
| 2019/0168890 | A1 | 6/2019 | Wise | |

FOREIGN PATENT DOCUMENTS

| | | | |
|---|---|---|---|
| EP | 1698823 | A2 | 9/2006 |
| EP | 1698823 | B1 | 4/2010 |
| EP | 2199206 | A1 | 6/2010 |
| EP | 2648174 | A3 | 10/2013 |
| JP | 2001243821 | A | 9/2001 |
| WO | 2009084049 | A1 | 7/2009 |
| WO | 2009090185 | A2 | 7/2009 |
| WO | 2009133326 | A2 | 11/2009 |

OTHER PUBLICATIONS

Dialight, PLC, Brochure, "Vigilent(R) LED Based Obstruction Lights," PDF Creation Date Feb. 29, 2016, 12 pages, Document No. Obstruction_Brochure_M, retrieved from company website www.dialight.com May 10, 2016.

SPX Corporation, Brochure, "FTS 361X-5 Medium Intensity Red LED Aviation Obstruction Lighting System," PDF Creation Date Feb. 11, 2016, 2 pages, Document No. FTS361X-120115, retrieved from company website www.spx.com May 10, 2016.

Flash Technology, Reference Manual, "Vanguard(R) FTS 370d, 370w, 370r LED Medium Intensity Obstruction Lighting System," Revision 18, Sep. 21, 2017, 104 pages, Part No. F7913702, retrieved from company website www.flashtechnology.com Dec. 7, 2017.

Data Sheet, Orga Model AOL 1000SA High Intensity Aeronautical Obstruction Light, 1 page, created 2007.

Promotional Sheet, Excelitas Technologies "Lighting Solutions for Safety and Security". 4 pages. Copyright 2011.

European Search Report, Application EP12160211, dated Aug. 7, 2013.

Dialight Corp., Product datasheet for D164 Series LED Red Beacon, 1 page, printed Jan. 21, 2011, Newmarket, England.

Installation and Operation Guide, "Horizon(TM) Medium Intensity Dual LED Lighting System," Manual No. EPM-00000043-001, Revision E, copyright 2014, 17 pages, Hughey & Phillips, LLC, Urbana Ohio, retrieved from company website www.hugheyandphillips.com Apr. 23, 2018.

* cited by examiner

LIGHTING SYSTEM CONFIGURED TO EMIT VISIBLE AND INFRARED LIGHT

CROSS-REFERENCE TO RELATED APPLICATIONS

This application claims priority to U.S. provisional patent application No. 62/270,836, filed Dec. 22, 2015, the entire contents of which is expressly incorporated by reference herein.

FIELD

The present invention relates generally to lighting systems, such as obstruction lighting systems.

BACKGROUND

Obstructions to aircraft navigation, such as towers, cables and tall buildings are typically fitted with visibly perceivable elements to render these structures highly visible to approaching aircraft. These obstruction lights are placed in accordance with a set plan at levels on all obstructions that are potential hazards to air navigation. Standards for obstruction lighting have been established by the U.S. Federal Aviation Administration (FAA), International Civil Aviation Organization (ICAO), and Australia Civil Aviation Safety Authority (CASA) among others.

While visible-light obstruction lighting performance standards are well established, there are no standards for compatibility of obstruction lights with night vision imaging systems ("NVIS") commonly used by military and emergency/rescue air operators. NVIS systems are typically configured to receive and amplify low-level infrared radiation to form a "night vision" image, which improves air operators' ability to navigate at night and under poor visibility conditions. The lack of performance standards for compatibility with NVIS equipment is particularly problematic for obstruction lights that utilize light emitting diodes (LEDs), since LEDs generate considerably less heat (and thus less infrared radiation) than conventional incandescent and xenon strobe light sources, making them difficult to see with NVIS. Providers of obstruction lighting systems have attempted to solve this problem by co-mingling some infrared light emitting diodes or other infrared emitters (hereafter generally "IRLEDs") with their visible-light emitters. However, since the optical systems of these obstruction lighting systems are designed to emit visible light, the lighting pattern, intensity and other characteristics of the infrared light emitted by the co-mingled IRLEDs are often compromised. There remains a need for an obstruction lighting system that provides satisfactory light emissions for both visible light and infrared light.

SUMMARY

A lighting system configured to emit both visible and infrared light is disclosed according to an embodiment of the present invention. The system comprises a first light emitter that is configured to emit light outside a visible-light spectrum. A second light emitter is configured to emit visible light. The lighting characteristics of the second light emitter are altered when a fault condition is present in the first light emitter, thereby providing a visually perceivable indication of the fault.

In one embodiment a lighting system includes a first light emitter configured to emit light outside a visible-light spectrum. A second light emitter is configured to emit light in a visible-light spectrum. The first and second light emitters are co-located, such as in a stacked arrangement with one light emitted atop the other. The amount of visible illumination of the second light emitter may correspond to a correlated radiant intensity of infrared light emitted by the first light emitter.

In another embodiment of the present lighting system a first light emitter is configured to emit light in an infrared light spectrum. A second light emitter is arranged to emit light in a visible-light spectrum. A controller is configured to control the operation of the first and second light emitters. A monitor is arranged to detect a fault condition of the first light emitter and communicate the fault condition to the controller. The controller alters lighting characteristics of the second light emitter by turning off the second light emitter while the fault condition of the first light emitter is present. The light emissions of the first and second light emitters may be correlated. In addition, the first and second light emitters may be co-located such that the second light emitter is atop the first light emitter in a stacked arrangement. The first and second light emitters preferably have separate optical systems.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
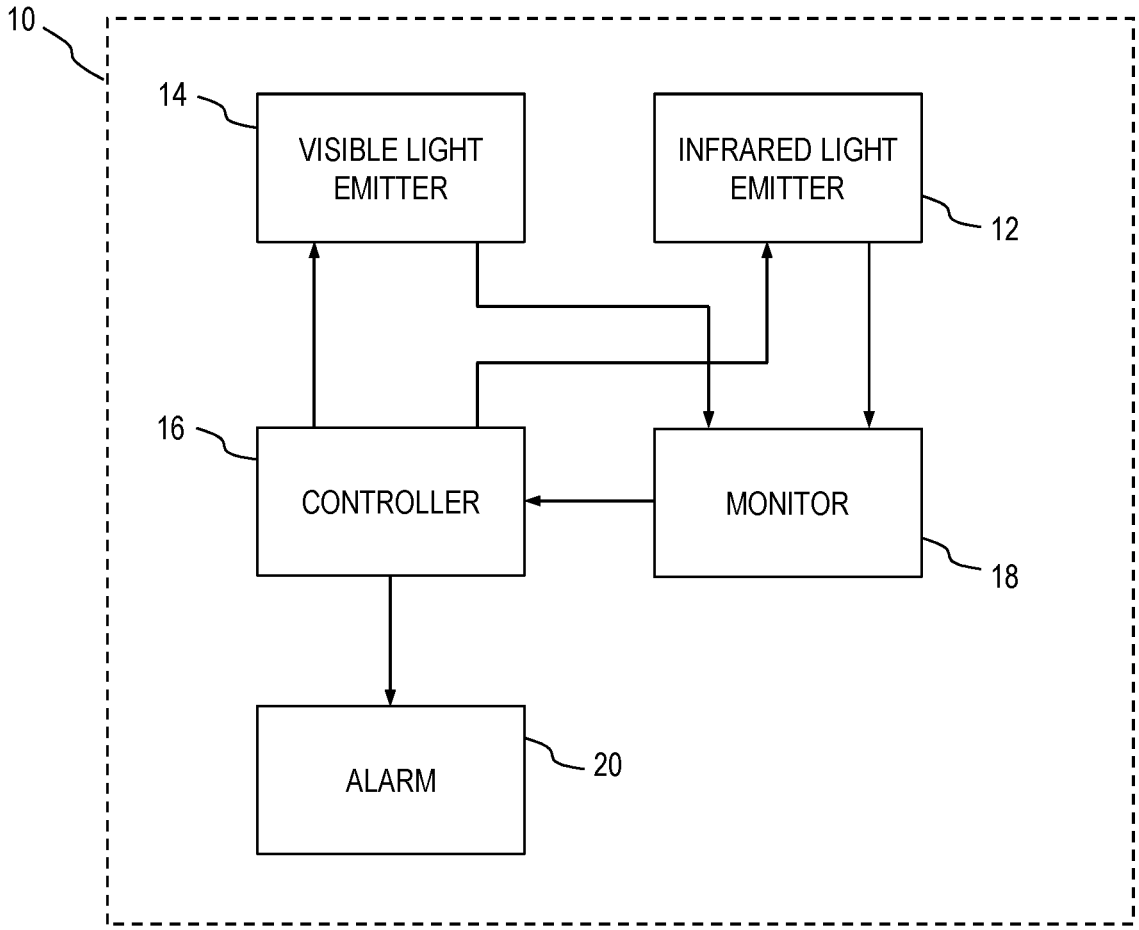
FIG. 1 is a block diagram showing the general arrangement of a lighting system configured to emit both visible and infrared light according to an embodiment of the present invention.

The general arrangement of a lighting system 10 configured to emit both visible and infrared light is shown in FIG. 1 according to an embodiment of the present invention. System 10 comprises a first light emitter 12 that is configured to emit light outside a visible-light spectrum such as, without limitation, in the infrared light spectrum. A second light emitter 14 is configured to emit light in a visible-light spectrum that is perceivable to the unaided eye.

A controller 16 controls the operation of first and second light emitters 12, 14 respectively. Controller 16 may, for example, establish and control the amount of voltage and/or current that is supplied to first and second light emitters 12, 14 respectively. Controller 16 may also control the on-and-off operation of first and second light emitters 12, 14 such as, for example, turning either or both of the light emitters ON at a first desired time or at dusk, and turning either or both of the light emitters OFF at a second desired time or at dawn. Controller 16 may optionally utilize a local or remote photocell or a global positioning satellite (GPS) receiver to determine when the light emitters 12, 14 are to be turned on and turned off. Controller 16 may further "flash" either or both of light emitters 12, 14 with a desired ON-OFF duty cycle or pattern, or turn either or both light emitters ON or OFF in a predetermined manner or in response to predetermined conditions.

Monitor 18 is coupled to and monitors the status of either or both of first and second light emitters 12, 14 respectively. Status information may include, without limitation, the amount of voltage and/or current present in first and second light emitters 12, 14 respectively, or elements thereof (such as, for example, one or more individual visible or infrared light emitting diodes), whether the light emitters or any elements thereof have failed with an electrical open-circuit fault condition, whether the light emitters or any elements thereof have failed with an electrical short-circuit fault condition, the amount of light being emitted by the light emitters or elements thereof, and the wavelength of light being emitted by the light emitters or elements thereof. As a non-limiting example, measurement of the voltage across a light emitting diode will provide an indication of whether the light emitting diode is functioning or whether it has experienced an electrical open- or short-circuit voltage fault condition. Likewise, measurement of the current through a light emitting diode will provide an indication of whether the light emitting diode is functioning, or whether it has experienced an open- or short-circuit electrical current fault condition.

If monitor 18 detects a predetermined fault condition in either or both of first and second light emitters 12, 14 (or the elements that comprise them) a fault signal is provided to controller 16 by the monitor. Controller 16 receives the fault signal from monitor 18 and activates a local and/or remote alarm 20 which may be, without limitation, an electronic, aural, visually perceivable, non-visually perceivable (e.g., infrared, ultraviolet) or tactile alarm signal.

Figure 2:
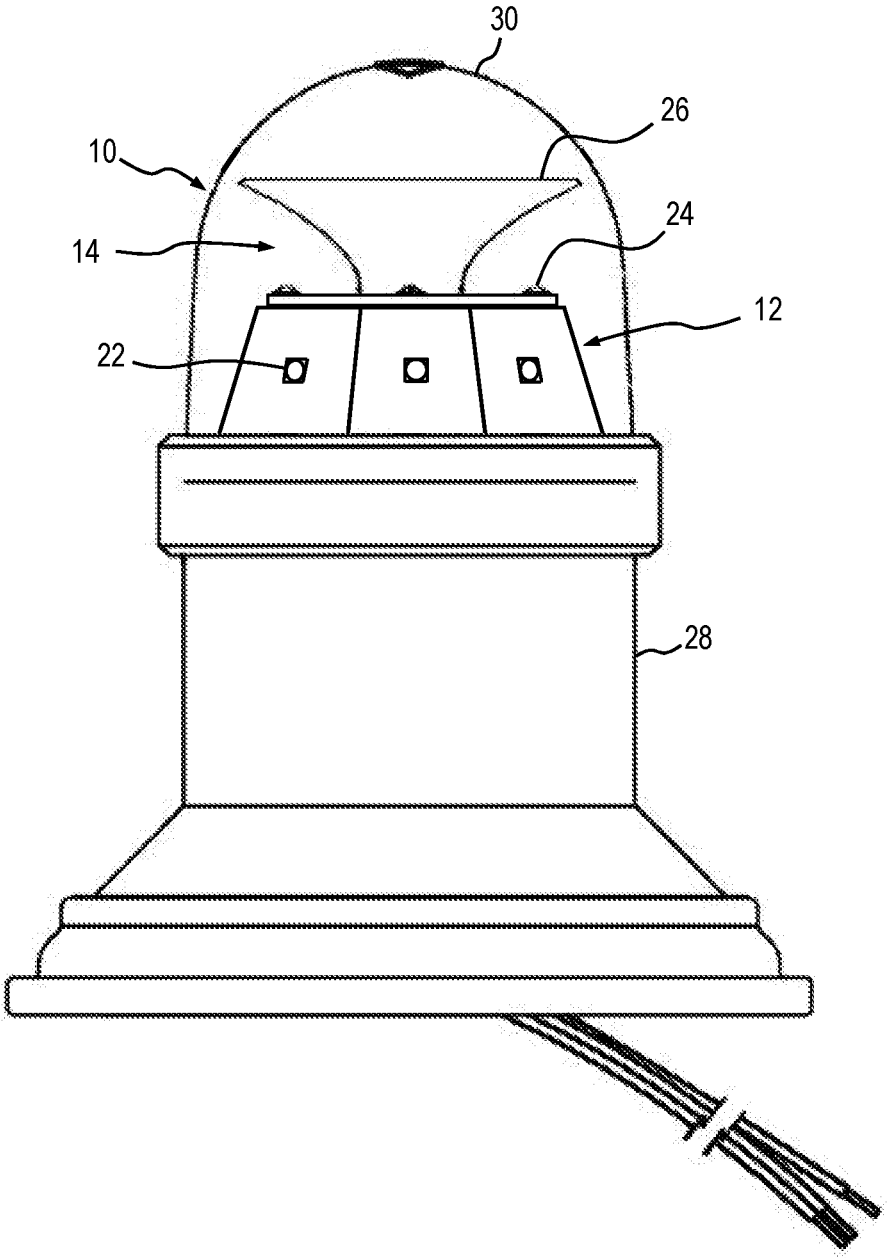
FIG. 2 shows an example lighting system according to an embodiment of the present invention.

In an embodiment of the present invention first and second light emitters 12, 14 respectively are steady-burning and are co-located as generally shown in FIG. 2. Monitor 18 monitors the status of first light emitter 12 configured as an infrared light emitter and, upon detection of a predetermined fault condition, provides a fault signal to controller 16. Controller 16 responds to the fault signal and provides a local alarm signal by "flashing" second light emitter 14, which is configured as a visible-light emitter, at a predetermined duty cycle until the fault is corrected. Second light emitter 14 may thus be operated to provide a local alarm signal with an ON-OFF duty cycle whereby the second light emitter is turned OFF for about one second and then turned ON for about fourteen seconds.

Alternatively, second light emitter 14 may be turned OFF by controller 16 and be kept in an OFF state to visually indicate a fault in first light emitter 12 until the fault is corrected, then be restored to its normal ON state while the first light emitter is again operational. This provides maintenance personnel with an indication that is visually perceivable to the unaided eye that first light emitter 12, which cannot be observed without the use of special NVIS equipment, has a fault condition.

First and second light emitters 12, 14 respectively may be configured such that the light emitted by the first and second light emitters has a predetermined corresponding relationship. In one embodiment the amount of visible illumination in foot-candles of second light emitter 14 corresponds to a correlated radiant intensity of infrared light emitted by first light emitter 12 in watts per steradian. This correlation between first and second light emitters 12, 14 respectively may result in a lighting system 10 that emits both visible and infrared light with a generally equivalent perceived intensity when second light emitter 14 is viewed with the unaided eye and when first light emitter 12 is viewed with NVIS equipment. In this arrangement lighting system 10 appears to an observer to be the same general distance away from the observer both when the lighting system is viewed by the observer with the unaided eye and when the lighting system is viewed by the observer with NVIS equipment. Prior lighting systems lack this correlation between the visible and infrared light emitters, resulting in a perceived appearance of the light being closer or farther away from the observer, depending upon whether the prior lighting system is viewed by the observer with the unaided eye or if the lighting system viewed by the observer with NVIS equipment. This lack of correlation between the visible and infrared light emitted by prior lighting systems results in a greater hazard to air navigation when the lighting system is an obstruction light, since the obstruction light will appear to be closer or farther from an observer in a nearby aircraft, depending upon whether the observer is using NVIS equipment or the unaided eye. The present invention overcomes this shortcoming.

Details of a non-limiting example lighting system 10 are shown in FIG. 2. First light emitter 12 is configured to emit light outside a visible-light spectrum such as, without limitation, infrared light. For example, the infrared light may be in the 850 nanometer (nm) region of the infrared spectrum. The infrared light may be generated by one or more IRLEDs 22. IRLEDs 22 are arranged and oriented such that infrared light emitted by the IRLEDs is directed generally outwardly and away from lighting system 10. In some embodiments a plurality of IRLEDs 22 may be arranged such that lighting system 10 emits infrared light outwardly about a 360 degree radius (or a portion thereof) of lighting system 10. In some embodiments IRLEDs 22 may be infrared emitters (e.g., infrared light emitting diodes) or any other suitable source of infrared emissions.

Second light emitter 14 is configured to emit light in a visible-light spectrum. The visible light may be generated by one or more visible-light light emitting diodes (LEDs) 24 and reflected outwardly by a reflector 26. In some embodiments a plurality of visible-light LEDs 24 may be arranged about reflector 26 such that lighting system 10 emits visible light outwardly about a 360 degree radius (or a portion thereof) of lighting system 10.

As further shown in FIG. 2, first and second light emitters 12, 14 respectively are co-located in a stacked arrangement. Second light emitter 14 is stacked atop first light emitter 12 in this embodiment, although a reverse arrangement with the first light emitter stacked atop the second light emitter is envisioned within the scope of the invention. Similarly, first and second light emitters 12, 14 may be laterally co-located in a generally side-by-side arrangement.

In the example embodiment shown in FIG. 2, IRLEDs 22 are arranged and oriented such that light generated by the IRLEDs is directed outwardly and away from lighting system 10. However, this arrangement is merely shown as one example optical arrangement and is not intended to be limiting in any way. For example, IRLEDs 22 may be arranged with a reflector similar to reflector 26 of second light emitter 14. Likewise, visible-light LEDs 24 may be arranged and oriented in a manner similar to first light emitter 12 such that reflector 26 is omitted and light generated by visible-light LEDs is directed generally outwardly and away from lighting system 10.

Lighting system 10 may further include a housing 28. Housing 28 can be configured with features that are sized and shaped to mount or attach lighting system 10 to structures and other equipment. Housing 28 may further enclose some portions or the entirety of controller 16, monitor 18 and alarm 20.

A cover globe 30 may enclose first and second light emitters 12, 14 respectively. Globe 30 may be generally transparent (i.e., "clear") or may be tinted or dyed to one or more desired colors, such as red.

Figure 3:
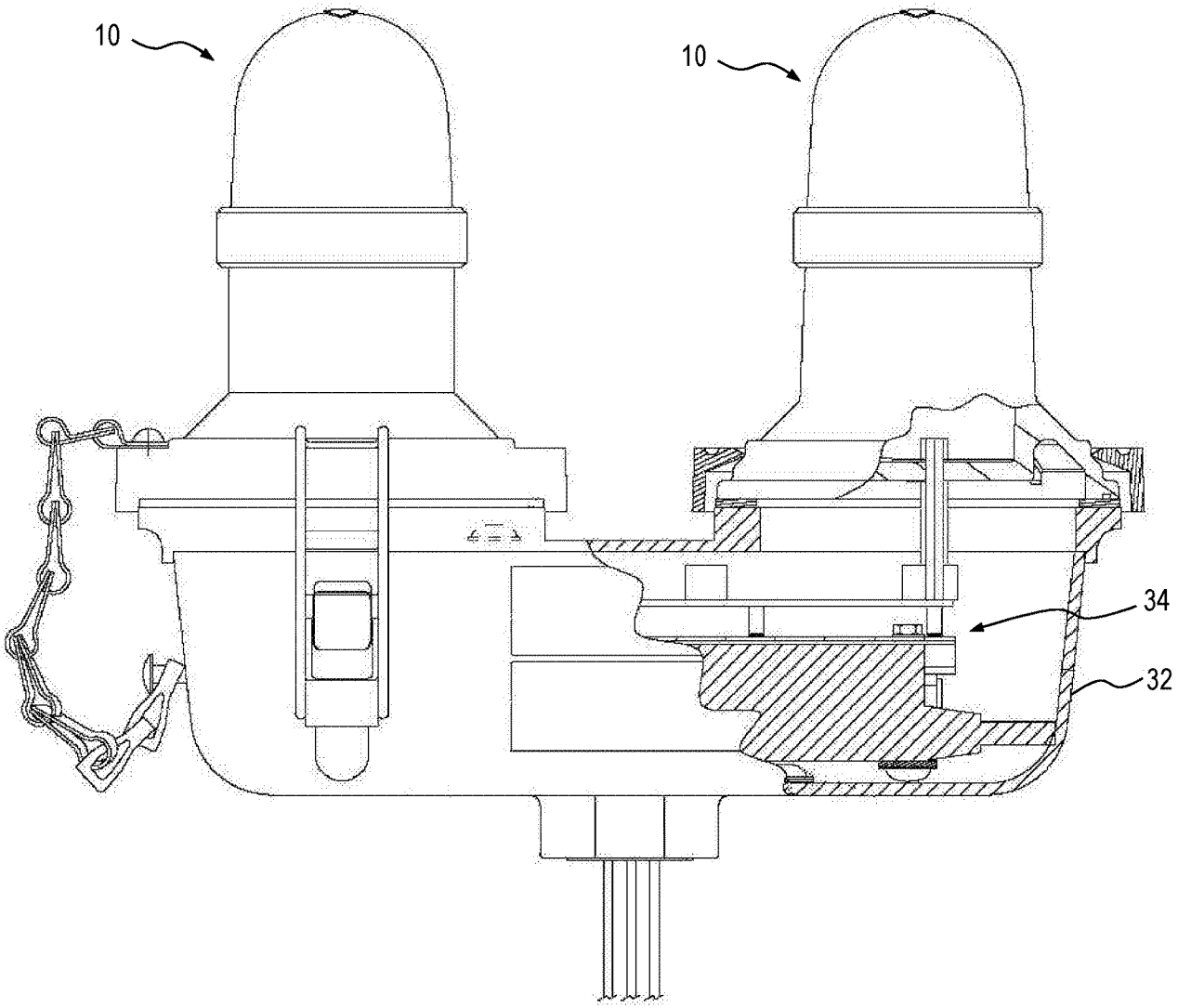
FIG. 3 shows an example lighting system according to another embodiment of the present invention.

With reference now to FIG. 3, in some embodiments of the present invention a plurality of lighting systems 10 may be utilized, and may be mounted to a common fixture 32 if desired. In addition, any suitable portions of lighting system 10 may be made common to plural lighting systems. For example, portions or all of controller 16, monitor 18 and alarm 20 may be made a common assembly 34 for plural lighting systems 10, and may be disposed within fixture 32, distributed among the plural lighting systems, or located remotely.

First light emitter 12 may utilize any type of emitter now known or later invented to emit light outside a visible-light spectrum. The IRLEDs 22 described herein are for illustration only and are not intended to be limiting in any way. Likewise, second light emitter 14 may utilize any type of visible-light emitter now known or later invented. The visible light emitting diodes 24 described herein are for illustration only and are not intended to be limiting in any way.

Optical systems that do not include a reflector 26 are envisioned within the scope of the invention. For example, either or both of light emitting diodes 22, 24 may be directed or aimed outwardly from lighting system 10, and may optionally include optical elements such as, but not limited to, baffles and lenses to shape and direct the light emitted from the light emitting diodes.

Referring again to FIG. 2, preferably first light emitter 12 and second light emitter 14 utilize separate optical systems comprising optical elements such as, without limitation, light emitter aiming, reflectors, baffles, and lenses, each optical system being tailored to the spectrum of light emitted. The use of a first optical system tailored to first light emitter 12 and a separate, second optical system tailored to the second light emitter 14 allows for optimization of the efficiency (e.g., light intensity, distribution and pattern) of the particular spectrum of light emitted. This provides a lighting system 10 with an optimized first light emitter 12 and an optimized second light emitter 14 that work together to provide predetermined lighting characteristics without compromising the optical characteristics of either of light emitters 12, 14. This separate optical arrangement overcomes the drawbacks of prior lighting systems utilizing a common optical system for both visible and infrared emitters, which would necessarily compromise the efficiency of the visible light emitter, the infrared light emitter, or even both light emitters. An optimized optical system for each of first light emitter 12 and second light emitter 14 may comprise one or more light emitters oriented generally away from lighting system 10, a reflector or reflectors, baffles, lenses, light tubes, or any combination thereof along with any other light-shaping and modifying elements now known or later conceived.

Controller 16, monitor 18 and alarm 20 may be separate elements comprising any suitable combinations of discrete electronic components and integrated circuits. Alternatively, some portions or all of controller 16, monitor 18 and alarm 20 may be integrated together. Furthermore, the functions of some or all of controller 16, monitor 18 and alarm 20 may be managed by a device capable of storing and executing predetermined instructions such as, without limitation, a computer, a microprocessor or a microcontroller.

While this invention has been shown and described with respect to a detailed embodiment thereof, it will be understood by those skilled in the art that changes in form and detail thereof may be made without departing from the scope of the claims of the invention. For example, although the present disclosure has been presented in the context of obstruction lighting, this is merely for the purpose of illustration. Those skilled in the art will appreciate that the present invention may be used to advantage in connection with any type of lighting equipment and/or any suitable lighting application.

What is claimed is:

1. A lighting system, comprising:

a first light emitter configured to emit light outside a visible-light spectrum; and a second light emitter configured to emit light in a visible-light spectrum, an amount of light emitted in the visible light spectrum by the second light emitter having a predetermined corresponding relationship to a radiant intensity of light emitted outside the visible light spectrum by the first light emitter, such that the lighting system appears to an observer to be the same intensity both when the lighting system is viewed by the observer with an unaided eye and when the lighting system is viewed by the observer with an imaging device.

2. The lighting system of claim 1, further including a controller arranged to control the operation of the first and second light emitters.

3. The lighting system of claim 2, further comprising a monitor arranged to detect a fault condition of the first light emitter and communicate the fault condition to the controller.

4. The lighting system of claim 3 wherein the monitor is configured to detect an electrical current fault condition of the first light emitter.

5. The lighting system of claim 3 wherein the monitor is configured to detect a voltage fault condition of the first light emitter.

6. The lighting system of claim 3 wherein the monitor is configured to detect a fault condition of the amount of light emitted by the first light emitter.

7. The lighting system of claim 3 wherein the controller alters lighting characteristics of the second light emitter while the fault condition of the first light emitter is present.

8. The lighting system of claim 7 wherein the controller alters lighting characteristics of the second light emitter by turning off the second light emitter while the fault condition of the first light emitter is present.

9. The lighting system of claim 7 wherein the controller alters lighting characteristics of the second light emitter by periodically turning the second light emitter on and off at a predetermined duty cycle while the fault condition of the first light emitter is present.

10. The lighting system of claim 3, further including a housing, the controller and monitor being disposed within the housing.

11. The lighting system of claim 3, further including an alarm coupled to the controller, the alarm being configured to issue an alert signal relating to the fault condition when commanded by the controller.

12. The lighting system of claim 1 wherein the first light emitter is an infrared light emitter.

13. The lighting system of claim 1 wherein the second light emitter is a visible-light light emitting diode.

14. The lighting system of claim 1 wherein the first emitter and the second emitter have separate optical systems.

15. The lighting system of claim 1 wherein the first and second light emitters are co-located such that the second light emitter is arranged atop the first light emitter in a stacked arrangement.

16. The lighting system of claim 1 wherein the first light emitter and the second light emitter emit light about a 360 degree radius.

17. A lighting system, comprising:

a first light emitter configured to emit light in an infrared light spectrum;

a second light emitter arranged to emit light in a visible-light spectrum;

a controller configured to control the operation of the first and second light emitters; and a monitor arranged to detect a fault condition of the first light emitter and communicate the fault condition to the controller, an amount of light emitted in the visible light spectrum by the second light emitter having a predetermined corresponding relationship to a radiant intensity of light emitted in the infrared light spectrum by the first light emitter, such that the lighting system appears to an observer to be the same intensity both when the lighting system is viewed by the observer with an unaided eye and when the lighting system is viewed by the observer with an imaging device, the first and second light emitters being co-located such that the second light emitter is atop the first light emitter in a stacked arrangement, the first and second light emitters having separate optical systems, and the controller altering lighting characteristics of the second light emitter by turning off the second light emitter while the fault condition of the first light emitter is present.

18. The lighting system of claim 17 wherein the first light emitter and the second light emitter emit light about a 360 degree radius.

19. A method for producing a lighting system, comprising the steps of:

selecting a first light emitter configured to emit light outside a visible-light spectrum;

selecting a second light emitter configured to emit light in a visible-light spectrum; and establishing an amount of light emitted in the visible light spectrum by the second light emitter to correspond to a radiant intensity of light emitted outside the visible light spectrum by the first light emitter, such that the lighting system appears to an observer to be the same intensity both when the lighting system is viewed by the observer with an unaided eye and when the lighting system is viewed by the observer with an imaging device.

20. The method of claim 19, further comprising the step of arranging the first emitter and the second emitter with separate optical systems.

* * * * *